US008939215B2

(12) United States Patent
McMiles

(10) Patent No.: US 8,939,215 B2
(45) Date of Patent: Jan. 27, 2015

(54) GASLESS PILOT ACCUMULATOR

(75) Inventor: Barry McMiles, Katy, TX (US)

(73) Assignee: The Subsea Company, Houston, TX (US)

( * ) Notice: Subject to any disclaimer, the term of this patent is extended or adjusted under 35 U.S.C. 154(b) by 212 days.

(21) Appl. No.: 13/116,429

(22) Filed: May 26, 2011

(65) Prior Publication Data

US 2011/0290496 A1 Dec. 1, 2011

Related U.S. Application Data

(60) Provisional application No. 61/389,328, filed on Oct. 4, 2010, provisional application No. 61/349,313, filed on May 28, 2010.

(51) Int. Cl.
*E21B 34/04* (2006.01)
*E21B 34/16* (2006.01)
*E21B 41/00* (2006.01)

(52) U.S. Cl.
CPC ..... *E21B 34/16* (2013.01); *E21B 41/0007* (2013.01)
USPC ..... 166/344; 166/368; 166/363; 166/364; 166/335

(58) Field of Classification Search
USPC ..... 166/344, 368, 363, 364, 335; 138/60, 138/61, 30, 31
See application file for complete search history.

(56) References Cited

U.S. PATENT DOCUMENTS

| | | | | | |
|---|---|---|---|---|---|
| 2,378,467 | A | * | 6/1945 | De Kiss | 138/30 |
| 3,131,921 | A | * | 5/1964 | Karbowniczek | 267/128 |
| 3,669,151 | A | * | 6/1972 | Fleming | 138/31 |
| 3,856,048 | A | * | 12/1974 | Gratzmuller | 138/31 |
| 3,987,708 | A | | 10/1976 | Uhrich | |
| 4,172,603 | A | * | 10/1979 | St. Clair et al. | 280/734 |
| 4,185,652 | A | * | 1/1980 | Zintz et al. | 137/78.2 |
| 4,324,101 | A | * | 4/1982 | Farr | 60/562 |
| 4,777,800 | A | | 10/1988 | Hay, II | |
| 4,821,799 | A | * | 4/1989 | Wong | 166/84.2 |
| 4,840,346 | A | * | 6/1989 | Adnyana et al. | 251/1.3 |
| 6,202,753 | B1 | | 3/2001 | Baugh | |
| 6,267,147 | B1 | * | 7/2001 | Rago | 138/31 |
| 6,418,970 | B1 | | 7/2002 | Deul | |
| 7,520,129 | B2 | | 4/2009 | Springett | |
| 7,926,501 | B2 | | 4/2011 | Springett et al. | |
| 2005/0022996 | A1 | | 2/2005 | Baugh | |
| 2005/0155658 | A1 | * | 7/2005 | White | 138/31 |
| 2006/0102357 | A1 | * | 5/2006 | Williams | 166/363 |
| 2010/0206389 | A1 | | 8/2010 | Kennedy et al. | |
| 2011/0266002 | A1 | | 11/2011 | Singh et al. | |

* cited by examiner

*Primary Examiner* — James G Sayre

(57) ABSTRACT

A gasless subsea accumulator having a series of opposing springs in two separate chambers defined by a central cross shaped member for translating force on a piston in the accumulator to dampen the movement of the piston. The body of the accumulator may be operably engaged to a bladder in fluid communication with one of the two chambers to provide additional dampening. The body may be vented through a port and have a port for controlling pressure on body through a pilot control circuit. The accumulator may be manually controlled by an ROV and operatively connected to a regulator.

19 Claims, 3 Drawing Sheets

GASLESS PILOT ACCUMULATOR

CROSS REFERENCE TO RELATED APPLICATIONS

This application claims priority to U.S. Provisional Patent Application No. 61/389,328 filed Oct. 4, 2010 entitled "Gasless Pilot Accumulator" and claims priority to U.S. Provisional Application No. 61/349,313 filed May 28, 2010 entitled Gasless Pilot Accumulator and each are incorporated by reference as if fully set forth herein.

BACKGROUND OF THE INVENTION

1. Field of the Invention

The present invention relates to accumulators and regulators. In particular, the present invention relates to accumulators and regulators that may be implemented in pressurized fluidic conditions or where remote hydraulic control of a regulator is required.

2. Description of Related Art

This invention preferably may be used for deepwater accumulators that supply pressurized fluid to control and operate equipment disposed below fluid levels.

Accumulators are typically associated with blowout preventers (BOP) in order to temporarily cease well bore operations, gate valves in order to control fluid flow and to divert various fluids to surfaces or other subsea locations, as well as hydraulically actuated connectors and similarly associated devices. Pressurized fluid is typically an oil or water based fluid with increased lubricity and corrosion protection.

Currently accumulators come in various styles, but most share the same underlying operative principle. This principle involves pre-charging each accumulator with pressurized gas to a pressure which closely approximates the minimally anticipated operative pressure, which often approaches the ambient temperature of the environment in which the accumulator will be used. By pre-charging an accumulator fluid may be optionally added to the accumulator, increasing the pressure of the pressurized gas and the fluid. Fluid introduced into the accumulator is therefore stored at a pressure at least as high as the pre-charged pressure and is capable of doing hydraulic work.

Accumulators are often styled to operate in a bladder, piston, or float type fashion. Bladder types open employ an expandable bladder which separates gasses from fluids. Piston types use a piston which translates along an axis to separate fluids from gasses. Float types use a float to provide a partial separation of fluid from gas and closing of a valve when the float approaches the bottom. This in turn prevents the escape of gas.

Pilot Accumulators are typically pre-charged with gas at approximately ambient pressure plus the minimum working pressure of the circuit. As accumulators are used in deeper water, the efficiency of conventional accumulators is decreased. In 1000 feet of seawater ambient pressure approximates 465 pounds per square inch. Thus, in order for an accumulator to provide a 500 psi differential at 1000 ft. depth, it is required to be pre-charged at 732.5 pounds per square inch. At about 4000 feet of depth, ambient pressure is approximates 930 pounds per square inch, requiring an initial pre-charge of 1430 pounds per square inch, when only 500 pounds per square inch is required for operations. And at 10,000 ft, these numbers are 4,650 plus 500 psi. This is problematic because cylindrical design often requires thicker walls, stronger end caps, tighter welds, and stronger materials merely to accomplish an operative working environment.

When higher working pressures are employed, larger deviations in translational pressure shifts occur. This requires stronger sealing mechanisms and more accurate gauges. When pressure variants are introduced into the environment, often being cold water, even more extraneous pressure is required to get an accumulator to operational status. For example subsea accumulators are often exposed to very cold temperatures after being pre-charged which causes them to lose pressure.

As the BOP is deployed, the ambient pressure increases, thus decreasing the efficiency of the gas accumulators and can render them useless and cause the system to lose functionality. To alleviate this problem, the current approach is to fit multiple parallel accumulators into the circuit with multiple pre-charge pressures to allow added control at different depths.

The use of these multiple accumulators adds another problem, as the rates of increase and decrease vary with the volume of gas contained in the system, thus making control erratic and changing dependent on the depth. Also as deployment takes place, the isolated fluid in the system loses pressure equal to the increase of the ambient pressure, requiring frequent adjustments to the internal pressure to keep the system within the control range required to operate the functions.

Due to the properties of the gas systems, increasing the pressure is not linear and follows a parabolic arc, thus limiting control at higher pressures.

Although these systems represent great strides in the area of accumulator technology, many shortcomings remain.

Thus there exists a need for an accumulator that is capable of operating at a higher pressure and not required to be overly pre-charged with pressure, not require multiple pre-charge pressures and not require frequent pressure increases during deployment and conversely, not require frequent decreases during recovery. Without decreases during recovery, due to error or equipment failure, the internal pressure at the surface can be as high as 3,000 psi plus the ambient pressure due to water depth. At 10,000 feet this could be 7,650 psi.

BRIEF DESCRIPTION OF THE DRAWINGS

The novel features believed to be characteristic of the invention are set forth in the appended claims. However, the invention itself, as well as a preferred mode of use and further objectives and advantages thereof, will best be understood by reference to the following detailed description when read in conjunction with the accompanying drawings, wherein:

DETAILED DESCRIPTION OF THE PREFERRED EMBODIMENTS

Figure 1:
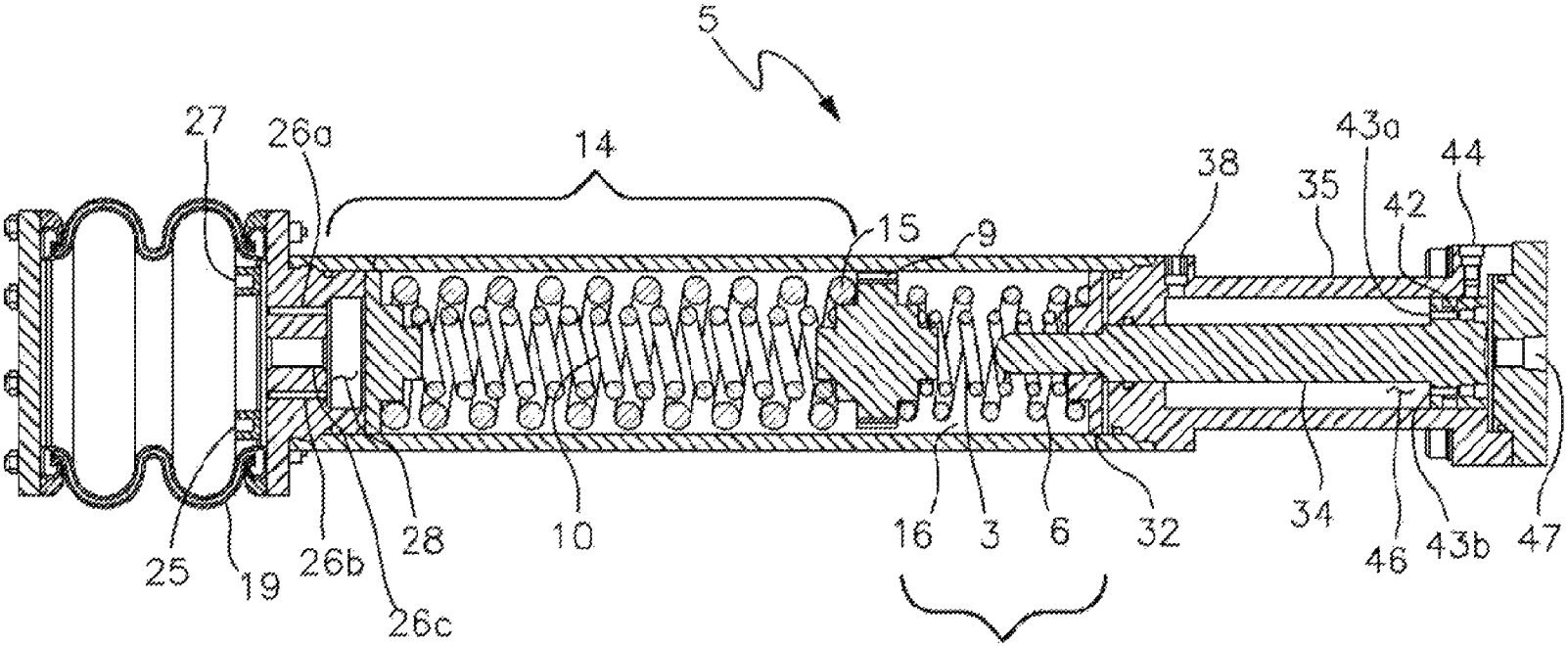
FIG. 1 illustrates a cross sectional view of a gasless pilot accumulator according to a preferred embodiment of the invention.

Referring now to FIG. 1, there is shown a cross sectional view of gasless pilot accumulator 5. Gasless pilot accumulator 5 includes a first stage 12 and second stage 14 where first stage 12 includes chamber 16 and a translational member 9 therebetween defining two chambers. First stage 12 has two primary load disbursing members 3 and 6, and second stage 14 has two secondary load disbursing members 10 and 15, with translational member 9 therebetween the two stages. Second stage 14 is communicatively associated with first chamber 12 via translational member 9. A regulator, not shown, is operatively associated with entry chamber 46 and is controlled by the pressure of fluid input and dispensed from gasless pilot accumulator 5 through port 47. Primary load disbursing member 3 can be capable of overcoming secondary load disbursing member 6 or load disbursing member 6 may be capable of overcoming load disbursing member 3 in order for translational member 9 to translate. Load disbursing members 3 and 6 may be of any of a variety of pre-determined springs well known in the art. Other biasing mechanism may also be employed that are well known in the art.

Gasless pilot accumulator 5 may or may not also include a bladder member 19 or use an external configuration for storing fluid. Bladder member 19 is operatively associated with second stage 14 in order to manipulate fluid into and out of second stage 14 through ports 26*a* and 26*b*. Bladder member 19 is positioned to translate in a substantially longitudinal direction relative to second stage 14. Bladder member 19 may substantially collapse and expand as fluid is input and dispelled. Another member (not pictured) may dispose or release force about an outer surface of bladder member 19 in order to dispose fluid into and out of second stage 14. In this particular embodiment, bladder member 19 is of a two chamber type in order to provide sufficient space for fluid. In other embodiments, bladder member 19 may be of a single chamber type or balloon type. In yet other embodiments bladder member 19 may be of three or more chambers and allow for sufficient amounts of fluid so that the ambient pressure may be imparted to the displacement piston 34 and also allow for compression of the fluid due to pressure or temperature.

In certain embodiments, second stage load disbursing member 15 may act in combination with second stage load disbursing member 10 to function as a load disbursing-damper combination. In certain embodiments, load disbursing member 6 and load disbursing member 3 may act in combination to function as a load disbursing-damper combination. Second stage load disbursing member 15 and second stage load disbursing member 10 supply opposing forces against load disbursing member 6 and load disbursing member 3 via translational member 9. Translational member 9 is capable of impacting longitudinal member 34.

Longitudinal member 34 protrudes through an annulus in plated member 32. Plated member 32 allows longitudinal member 34 to translate along a longitudinal direction while supplying a substantially equal load disbursement from load disbursing member 3 and primary load disbursing member 6. Plated member 32 substantially conforms to the diameter of chamber 28. Longitudinal member 34 translates along second chamber 35 while providing a entry chamber 46 to allow for movement of pilot control fluid. Pilot control fluid is connected to the regulator pilot piston through port 47. Longitudinal member 34 contains a seal 42 and ports 43*a* and 43*b* which allow for fluidic communication with an pilot control circuit via port 44. The pilot control circuit is configured to allow the increase or decrease of the pilot control circuit pressure and volume. Port 44 permits introduction of fluid to chamber 35. Ports 43*a* and 43*b* can be configured by the introduction of an orifice and a check valve which will control the opening speed of the regulator without changing the closing rate. This leads to a reduction of water hammer in the connected function circuits.

In operation, a member (not pictured) acts to exert and release force about bladder member 19. Bladder member 19 communicates fluid with ports 26*a*, 26*b*, and 26*c*. Second stage load disbursing member 15 and second stage load disbursing member 10 communicate force to translational member 9 which in turn makes contact with longitudinal member 34. In the event that ambient fluid begins to exert sufficient pressure on longitudinal member 34 and convey force towards translational member 9, second stage load disbursing member 15 and second stage load disbursing member 10 can act in combination to provide sufficient resistance and overcome primary load disbursing member 6 and secondary load disbursing member 3.

Various components of gasless pilot accumulator 5 may be made from a wide variety of materials. These materials may include metallic or non-metallic, magnetic or non-magnetic, elastomeric or non-elastomeric, malleable or non-malleable materials. Non-limiting examples of suitable materials include metals, plastics, polymers, wood, alloys, composites and the like. The metals may be selected from one or more metals, such as steel, stainless steel, aluminum, titanium, nickel, magnesium, or any other structural metal. Examples of plastics or polymers may include, but are not limited to, nylon, polyethylene (PE), polypropylene (PP), polyester (PE), polytetraflouroethylene (PTFE), acrylonitrile butadiene styrene (ABS), polyvinylchloride (PVC), or polycarbonate and combinations thereof, among other plastics. Gasless pilot accumulator 5 and its various components may be molded, sintered, machined and/or combinations thereof to form the required pieces for assembly. Furthermore gasless pilot accumulator 5 and its various components may be manufactured using injection molding, sintering, die casting, or machining.

Figure 2:
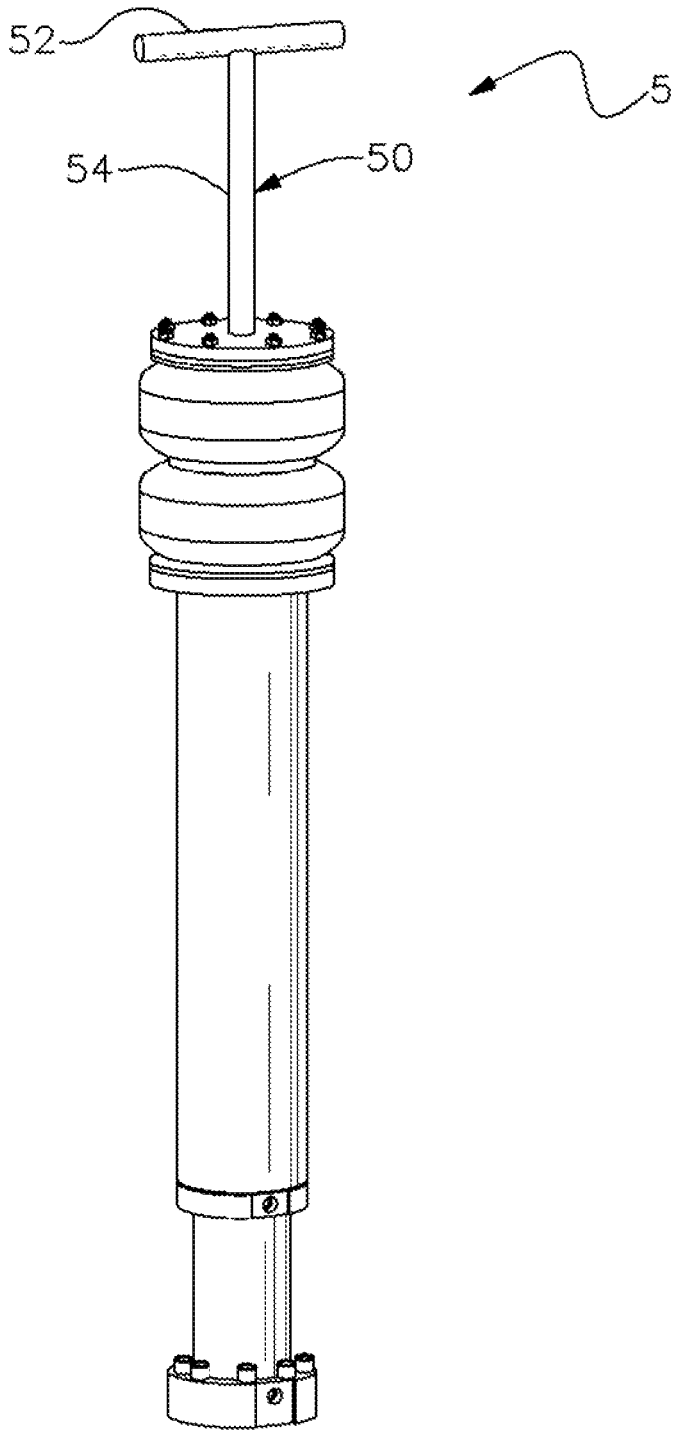
FIG. 2 illustrates a perspective view of a gasless pilot accumulator with T bar control arm according to a preferred embodiment of the invention.

Referring now to FIG. 2, an embodiment of gasless pilot accumulator 5 illustrated in FIG. 1, is shown including a manual override mechanism 50. Manual override mechanism 50, includes a handle portion 52 which connects to a shaft portion 54. Shaft portion contains and end which opposes handle portion 52 and includes threads for mating with a component disposed within gasless pilot accumulator 5. Manual override mechanism 50 can be inserted into gasless pilot accumulator 5 by turning override mechanism 50 into threading to engage stage 14 and apply opposing force to load dispersing members 10 and 15 as shown and can be employed to override a shutoff mechanism. Manual override mechanism 50 can be operated by a remote operated vehicle in order to restore functionality to gasless pilot accumulator when it is directly mechanically connected to a regulator.

Figure 2A:
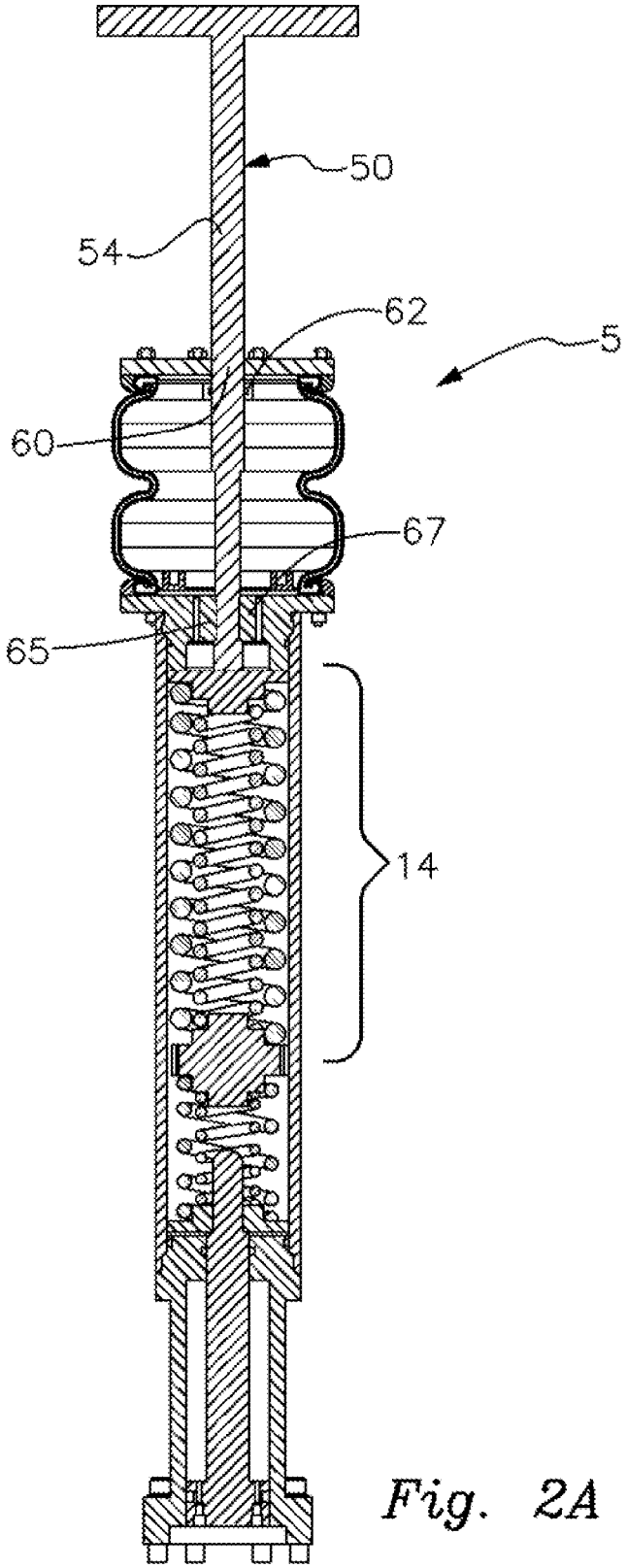
FIG. 2A illustrates a cross sectional view of a gasless pilot accumulator with T-bar control arm according to a preferred embodiment of the invention.

Referring now to FIG. 2A, there is shown a cross sectional view of an embodiment of gasless pilot accumulator 5 illustrated in FIG. 2. Manual override mechanism 50 may have threading disposed along its shaft at first threading 60 second threading 65, or both to facilitate variable movement of the override mechanism to engage load disbursing members in second stage 14 upon rotation of shaft 54. Mateable threading on shaft 54 at either points 60 or 65 with threading on the inside diameter of female apertures 62 and 67 may be employed to permit rotational movement of shaft 54 inward or outward to variably engage load disbursing members in second stage 14.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

All of the compositions and/or methods disclosed and claimed herein can be made and executed without undue experimentation in light of the present disclosure. While the compositions and methods of this invention have been described in terms of various embodiments, it will be apparent to those of skill in the art that other variations can be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

What is claimed is:

1. A subsea apparatus manipulating a wellbore component comprising:

a generally cylindrical body having a first, second and third chamber;

said first chamber having at least one load disbursing member;

said second chamber having at least one second load disbursing member, said chamber communicatively associated with the first chamber;

a freely translatable translational member disposed between said disbursing members said translational member being opposably actuated by said load disbursing members;

a longitudinal member having a first portion disposed within said first chamber for receiving force; and a second portion of said longitudinal member disposed in said third chamber isolated from said first and second chambers;

wherein at least one of the load disbursing members is capable of overcoming at least one other load disbursing member to cause the translational member to dampen movement of said longitudinal member.

2. The subsea apparatus of claim 1 further comprising a bladder member operatively associated with the at least one second chamber for manipulating fluid communication within the at least one second chamber.

3. The subsea apparatus of claim 1 further comprising a chamber in fluid communication with the bladder member for supplying and disposing fluid into said second chamber.

4. The subsea apparatus of claim 1, further comprising at least one dampening mechanism operatively disposed about the at least one first longitudinal member for lessening a load displaced upon at least one of said first and second load disbursing members.

5. The subsea apparatus of claim 4, further comprising at least one additional load disbursing member in said first chamber for lessening a load disposed upon at least one of said first and second load disbursing members.

6. The subsea apparatus of claim 1 further comprising a port in said third chamber for fluid communication about said second portion of said longitudinal member.

7. A gasless subsea accumulator comprising:

an elongated body having two ends and containing a first, second and third chamber wherein said first and second chambers are operatively engaged by a cross-shaped member having opposing stair step protrusions for engagement of springs;

said first chamber having first and second springs each engaged to one side of said stair step protrusions and biased against one end of said first chamber of said elongated body;

said second chamber having first and second springs each engaged to said opposing side of stair step protrusions and biased against an end of said second chamber;

a longitudinal member disposed within said first chamber engaged to said springs in said first chamber for receiving force said cross-shaped member opposably actuated by said springs in said first and second chambers;

a portion of said longitudinal member disposed in said third chamber, said chamber sealed from said first and second chambers.

8. The gasless subsea accumulator of claim 7 wherein said first spring in said first chamber is capable of overcoming said second spring in said first chamber to cause the cross-shaped member to dampen movement of said longitudinal member by engagement to said second springs of said second chamber.

9. The gasless subsea accumulator of claim 7 further comprising a bladder containing fluid for operable engagement to one of said chambers.

10. The gasless subsea accumulator of claim 7 further comprising a port operably engaged to one of said chambers.

11. The gasless subsea accumulator of claim 7 wherein said protrusions on said cross shaped member are cylindrical for engagement to said springs.

12. The gasless subsea accumulator of claim 7 further comprising a port to said third sealed chamber about the circumference of said longitudinal member.

13. The gasless subsea accumulator of claim 12 further comprising a port operably engaged to said third chamber,

14. The gasless subsea accumulator of claim 9 wherein said bladder comprises at least two flexible chambers.

15. The gasless subsea accumulator of claim 9 wherein said bladder is operably connected to a reservoir of pressurized fluid.

16. A gasless subsea accumulator comprising:

an elongated body having two ends and containing a first and second chamber operatively engaged by a T-shaped member having opposing stair step circular protrusions for engagement of springs;

said first chamber having two springs each engaged to one side of said stair step protrusions and biased against one end of said first chamber;

said second chamber having two springs each engaged to said opposing side of stair step protrusions and biased against an end of said second chamber;

a longitudinal member having two ends, where said member is disposed within said first chamber and engaged to said springs on said first end in said first chamber for receiving force said T-shaped member opposably actuated by said springs in said first and second chambers; and a third chamber sealed from said first two chambers about a portion of said longitudinal member.

17. The gasless subsea accumulator of claim 16 wherein said springs in said first chamber are of different force.

18. The gasless subsea accumulator of claim 16 wherein said springs in said second chamber are of different force.

19. The gasless subsea accumulator of claim 16 wherein said elongated body has a port disposed in said third chamber of said elongated body.

* * * * *